US005323550A

United States Patent [19]

Taylor et al.

[11] Patent Number: 5,323,550

[45] Date of Patent: Jun. 28, 1994

[54] SOLE PLATE TEMPERATURE CONTROL INCLUDING DIFFERENTIAL EXPANSION

[75] Inventors: John C. Taylor, Balladoole; Vincent J. Garvey, Port Erin; Martin C. Critchley, Castletown, all of Isle of Man

[73] Assignee: Strix Limited, Castletown, Isle of Man

[21] Appl. No.: 861,840

[22] PCT Filed: Dec. 20, 1990

[86] PCT No.: PCT/GB90/02001

§ 371 Date: Aug. 20, 1992

§ 102(e) Date: Aug. 20, 1992

[87] PCT Pub. No.: WO91/09169

PCT Pub. Date: Jun. 27, 1991

[30] Foreign Application Priority Data

Dec. 20, 1989 [GB] United Kingdom ..... 8928761

[51] Int. Cl.[5] ..... D06F 75/26; H05B 1/02

[52] U.S. Cl. ..... 38/82; 219/253

[58] Field of Search ..... 38/74, 82, 88, 93; 219/246, 250, 251, 252, 253; 200/3, 5 B, 6 R, 6 BB, 6 C, 177

[56] References Cited

U.S. PATENT DOCUMENTS

| | | | |
|---|---|---|---|
| 1,535,751 | 4/1925 | Turenne | 219/253 |
| 1,558,077 | 10/1925 | Cheeseman | 219/253 |
| 2,024,856 | 12/1935 | Graham | 219/253 X |
| 2,154,042 | 4/1939 | Gough | 219/253 X |
| 2,201,115 | 5/1940 | Reingruben et al. | 38/82 |
| 2,797,292 | 6/1957 | Polivka | 219/251 X |
| 4,345,389 | 2/1982 | Balchunas | 38/82 X |
| 4,433,231 | 2/1984 | Balchunas | 219/253 |

FOREIGN PATENT DOCUMENTS

| | | |
|---|---|---|
| 10834348 | 1/1955 | France . |
| 397501 | 9/1933 | United Kingdom . |

*Primary Examiner*—Clifford D. Crowder
*Assistant Examiner*—Ismael Izaguirre
*Attorney, Agent, or Firm*—Bacon & Thomas

[57] ABSTRACT

Thermostatic control of an electric iron is achieved through utilizing the expansion and contraction of the iron's sole plate relative to a low expansion reference member. In one embodiment, a flexible reference member extends from a fixed mounting at the tip of the sole plate to a switch unit at the rear of the sole plate. The reference number is connected to, and held in tension by, a snap acting actuator within the switch unit, such that as the sole plate expands, the free end of a blade is pulled by the reference member to cause a contact carrying tongue to snap away from a contact to interrupt the power supply. In addition, the temperature of operation may be controlled by varying the effective length of the reference member such as, for example, by deflecting it laterally by a cam member.

14 Claims, 7 Drawing Sheets

SOLE PLATE TEMPERATURE CONTROL INCLUDING DIFFERENTIAL EXPANSION

BACKGROUND OF THE INVENTION

1. Field of the Invention

The present invention relates to electric irons, and more particularly to thermostatic controls for electric irons.

2. Description of Prior Art

A typical iron control consists of a bimetal actuator which actuates a microswitch which controls the electrical supply to the heating element. The bimetal is usually mounted by a screw on a boss on the sole plate, and is heated by conduction of heat from the sole plate. This results in a thermal lag which leads to the iron temperature overshooting its nominal, set temperature when heating up particularly on initial turn on. This is obviously undesirable as clothing may be damaged. Also, the sole plate temperature undershoots when the iron is cooling down before power is resupplied to the element. Thus the temperature variation of the sole plate is considerably larger than that measured for the thermostat alone.

Furthermore, depending on where the bimetal is mounted on the sole plate, it may experience a higher or lower temperature than the average sole plate temperature. For example if the bimetal is too close to the element, it will experience too high a temperature and the control will therefore initially trip at lower sole plate temperatures than desired and clothing will not be properly ironed.

Various steps have been taken to try to improve such controls, particularly with the advent of cordless irons where high wattages are employed to quickly bring the iron back to temperature when it is replaced on its stand, and where the problems of temperature overshoot are therefore greater.

One approach has been to introduce electronic controls. However these controls are inherently unsuitable for high temperature and high humidity conditions which are typical in steam irons. Other attempts have been made to improve the performance of the bimetals, but these have not been particularly successful.

SUMMARY OF THE INVENTION

The present invention therefore seeks to provide an improved thermostatic control which does not suffer from the inherent draw backs associated with the controls described above.

From a first aspect the present invention provides an iron comprising a sole plate, a low expansion reference member which is fixed at one end with respect to the sole plate and extends over a major portion of the length of the sole plate, and is connected at its other end to a switch means which is activated by the relative movement of said reference member with respect to said sole plate which occurs as a result of the expansion and contraction of the sole plate.

Thus in accordance with the invention, the thermal expansion of the sole plate itself is used to actuate a switch controlling the power supply to the element. The invention uses the critical member, the sole plate, directly and does not rely on conduction into a second member such as a bimetal. This leads to a control with a much improved response to temperature changes. The expansion and change in length of the sole plate is converted into an actuating movement by virtue of its expansion relative to a reference member of a material having a relatively low coefficient of thermal expansion such as Invar, glass or carbon fibre.

By using the expansion of the sole plate over a major portion of its length, not only is a larger movement obtained for actuation of the switch means, but also, the control will not be sensitive to local hot or cool spots.

Sole plates are normally constructed from aluminium or aluminium alloys. Typically therefore, extensions in sole plate length of the order of 1 mm are produced in conventionally shaped sole plates over the normal operating temperature range. This easily provides sufficient movement to actuate a switch, and a reference member of moderate cross-section will enable considerably more force to be provided than a normal bimetal.

The reference member may be a rigid member, such as a rod, but preferably it is a flexible member, which is held in tension with respect to the sole plate. In particularly preferred embodiments the flexible member itself may be in the form of a tape or string. Preferably the switch means applies a tensile force to the reference member.

The reference number is preferably fixed at the front end of the sole plate and extends back to the switch means which is mounted at the rear of the sole plate.

The switch means of the present invention may be of any convenient type, but preferably it is a snap-acting microswitch for example an over-centre type microswitch. Different forms of such microswitches are well known and are widely used already in iron thermostatic controls where they are actuated by the movement of a thermally responsive bimetal. One known device comprises two generally rectangular, apertured leaf members which overlie one another and which are joined, by welding, for example, at one end. One leaf member carries a contact at its other end and is movable with respect to the other leaf member which is fixed at its other end. A 'C' spring extends between the contact carrying leaf and a tongue formed on the other leaf member and extending into the aperture. The contact carrying leaf member is biased towards or away from the other leaf member and thus opens or closes the switch contacts depending on the relative position of the leaf members. The joined ends of the leaf members (i.e. the "free" end of the assembly) are deflected by an actuating member to change the device geometry and operate the switch. This type of microswitch will herein after be referred to as a "C-spring type microswitch".

In a preferred embodiment, therefore a flexible member is attached to the joined ends of the C-spring type microswitch leaf members to actuate the switch. This arrangement also allows, by suitable setting, the microswitch leaf members to tension the flexible reference member.

In a particularly preferred embodiment the movable microswitch leaf member does not carry a contact, but instead this is provided remotely from the movable leaf member on a separate member. The contact is moved by means of a push and/or pull rod, for example, and the snap-acting device is in this case serves only as an actuator and is referred to hereinafter as a "C-spring type actuator".

This arrangement has the advantage that the leaf members of the microswitch need not be current carrying. This in turn means that the various elements of the microswitch need not be electrically continuously joined at one end but may instead be pivotally mounted together, for example by knife edge/groove pivots. Normally a pivotal connection between the leaf members would not be contemplated since the contacts carry relatively large currents (5 to 10 amps), which would have to pass through the pivot.

In the non-pivotally mounted construction, the resilience of the movable leaf member acts against the 'C' spring which provides the contact pressure. This contributes to low contact pressures and low pull apart forces at the moment of contact opening. Low contact pressure leads to arcing and welding at the contacts, and low pull apart forces mean that any micro-welds which do form are not easily broken. This phenomenon is known in the art as "spiking". When a micro-weld does occur, the temperature of the sole plate must rise above its nominal setting in order to generate sufficient force on the microswitch to break the weld. Thus will appear as a "spike" in a temperature-time plot. To allow for "spiking", the average temperature of the control must be set lower than desired so that the higher "spike" temperature will not damage clothing.

Where the movable contact is operated by a push rod or pull rod, there preferably should be a clearance or lost motion to allow for contact wear. However where a push rod is in contact with the microswitch and the contact, these two interfaces may be so designed as to wear at the same rate as the contacts so that contact wear does not effect the clearance and hence the calibration of the switch. Preferably, however, the push rod or pull rod is in contact with only one of the members. In one embodiment, it is in contact with the leaf member at one end and is arranged with clearance to the contact carrying member at its other end so that when the leaf member trips in the direction to open the contacts, it will accelerate the rod so that the rod will impact the contact carrying member giving an impetus to break welds at the contacts.

In a particularly simple embodiment, the microswitch may comprise a single blade type actuator of the type described generally in UK Patent Specification GB 657434. Such actuators comprise a strip or sheet of resilient material having a tongue released therefrom between two outer limbs, the tongue being connected to the strip at one end and free at the other. The outer limbs are joined at the free end of the tongue, and the blade is deformed at one of its end regions, at least, for example by crimping or bending, so as to dish the blade along its length and across its breadth so that it can be caused to reverse its curvature with a snap action. This type of actuator will hereafter be referred to as a "single blade actuator of the kind described".

In a preferred embodiment, it is the end of the blade adjacent the free end of the tongue which is deformed and mounted to a support fixed relative to the sole plate, and the flexible reference member connected, in tension, to the opposite end of the blade. As the sole plate expands and contracts, the free end of the blade will move relative to the support, and at a desired point, the actuator will reverse its curvature with a snap action and so move the tongue from its rest position to another with a snap action. As described above, the tongue may mount a contact directly or operate a remote contact.

The use of a flexible reference member such as a wire or tape also facilitates the variation of the set point of the switch and hence the sole plate temperature, in that the temperature at which the switch means will trip can be easily changed merely by varying the effective length of the reference member. When the reference member is connected to microswitches or actuators as described above it will be appreciated that by varying the length of the reference member, the free ends of the respective actuators will be moved, and thus their geometry changed, resulting in a greater or lesser expansion of the sole plate required to trip the actuator. In one preferred embodiment, the reference member is generally straight in the maximum temperature setting of the iron and the temperature setting is reduced from the maximum when the effective length of the reference member is reduced. A portion of the reference member may be deflected away from a fixed reference point by a cam means or the like which is linked to a temperature control dial which is moved by the user. The amount of deflection is determined by the cam profile, which can be such as to minimise wasted movement of the control knob from an 'off' position to the minimum operating temperature setting. In another embodiment, the length of the reference member is varied by twisting it locally, about an axis generally perpendicular to its length, into a generally S shape. This is particularly preferred since it substantially avoids introducing lateral stresses into the system. It will be appreciated that the deflection or twisting may be effected at substantially any point along the length of the reference member, which allows great flexibility in iron layout, since it is no longer necessary to provide the temperature control directly above the switch unit as at present. Thus it may be possible in accordance with the invention to combine the steam control and temperature controls on a steam iron. For example, the same actuator or concentric actuators could be used to twist or cause deflection the reference member and also to open or close the steam valve, since the thermostatic control actuator no longer needs to be in close proximity to the thermostat as was previously the case.

It is preferred that the iron of the present invention also comprises thermal protection means which disable the element in the event that the thermostatic control fails and the iron overheats. In one preferred embodiment, the tensioned flexible reference member is fixed with respect to the sole plate by means of a fusible plug, such that when the critical sole plate temperature is exceeded, the plug melts and releases the tension in the reference member, which causes opening of a set of contacts in the switch means. Thus the switch means may also include contacts which are held shut by the reference member during normal operation of the iron but which are opened when the tension in the reference member is released. It can be envisaged that a similar arrangement would be possible with a rigid reference member held in compression between the mounting and the switch means.

In a particularly simple arrangement, the movable contact is provided on a leaf spring member which is connected to the reference member, and which provides at least part of the tensioning of the latter. The reference member may thus be connected to both the leaf spring member of the thermal protection switch and a microswitch leaf member.

The thermal protection means may operate independently of the reference number. In one embodiment, for example, a thermally deformable member is resiliently biased into thermal contact with a portion of the sole plate by a spring mechanism, and arranged to deform at a critical, predetermined, temperature so as to release the spring mechanism to open a set of contacts to interrupt the power supply to the iron element. Conveniently the deformable member may be mounted on a leaf spring which mounts, or forms, one of the set of contacts, the leaf member being held in a pre-stressed condition by the deformable member. The deformable member may be similar in design to that shown in UK Patent Application GB 2204450. Preferably the thermostatic contacts and the thermal protection contacts are provided in an integral switch unit.

In known iron constructions, the temperature control means, as stated above is normally provided above the thermostat which is normally in the middle of the sole plate. Thus the power supply which enters at the back of the iron to facilitate flex replacement, must be conducted to the control unit by substantial bus bars. Furthermore, the thermal protection means is usually completely separate from the thermostat. Thus in use these components must all be connected together which is both cumbersome and expensive in terms of both time and materials.

From a second aspect, therefore, the present invention provides a switch unit for an electric iron comprising a support, said support mounting first switch means for thermostatic control of the iron, second switch means for thermal protection of the iron, and means for connection to a power supply.

By providing these components in a single support, which in use will be mounted at the rear of the iron sole plate, a more compact construction will result which will not require expensive assembly.

The support may be for example a one-piece plastics housing moulding into which the switch means are assembled, or a plastics support block into which the switch means are insert moulded for example. The switch means may be as described above in relation to the first aspect of the invention, and the invention also extends to an iron comprising a switch unit in accordance with the second aspect of the invention which is mounted at the rear of the sole plate.

In cordless irons, a mechanism may also be provided whereby, while the iron is removed from its charging base the switch contacts are held together, regardless of the sole plate temperature. This ensures that when the iron is replaced on its base, power will be supplied immediately to the heating element.

BRIEF DESCRIPTION OF THE DRAWINGS

Some preferred embodiments of the invention will now be described, by way of example only, and with reference to the following drawings in which.

DESCRIPTION OF THE PREFERRED EMBODIMENTS

Figure 1:
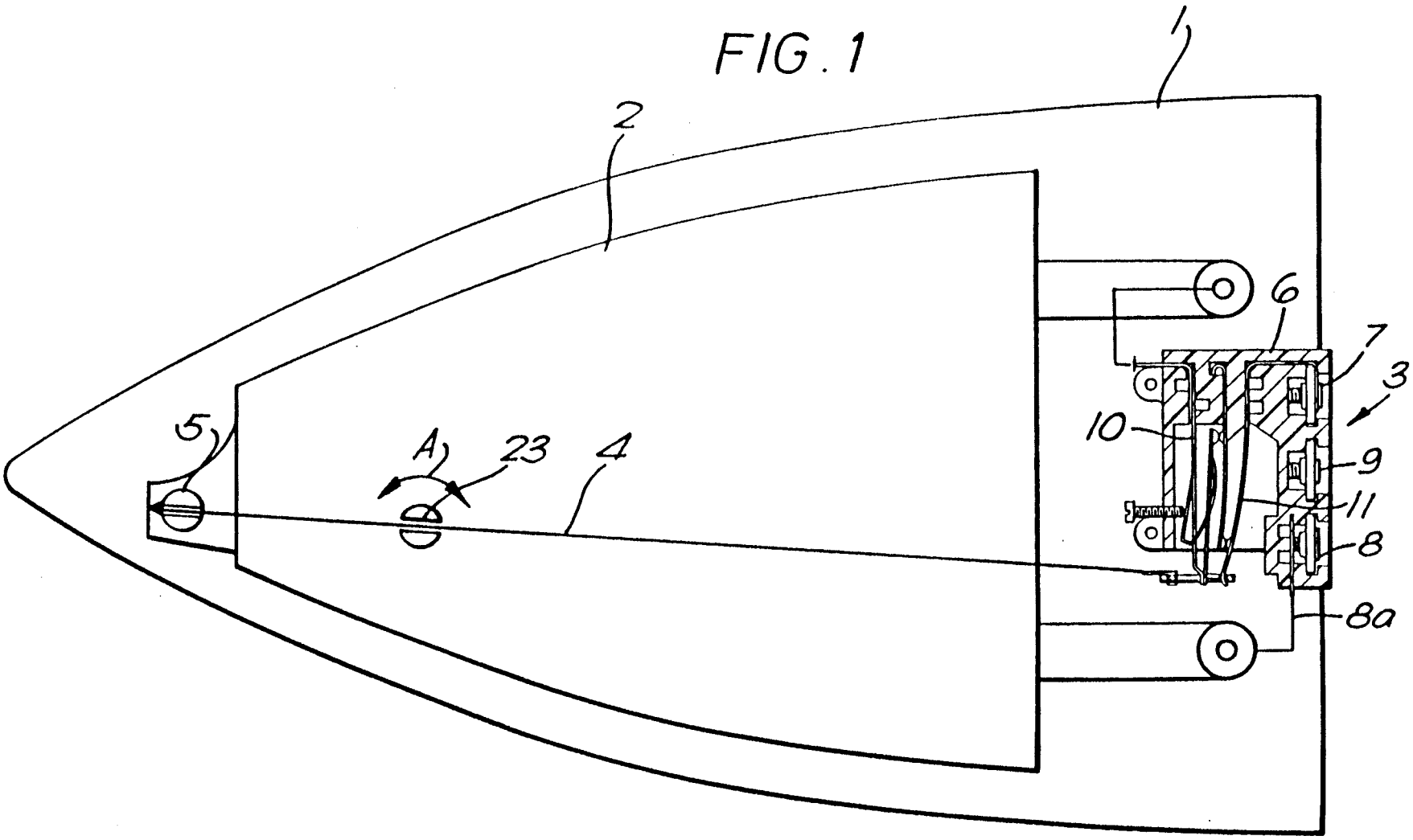
FIG. 1 shows a first embodiment of the invention.
Figure 2:
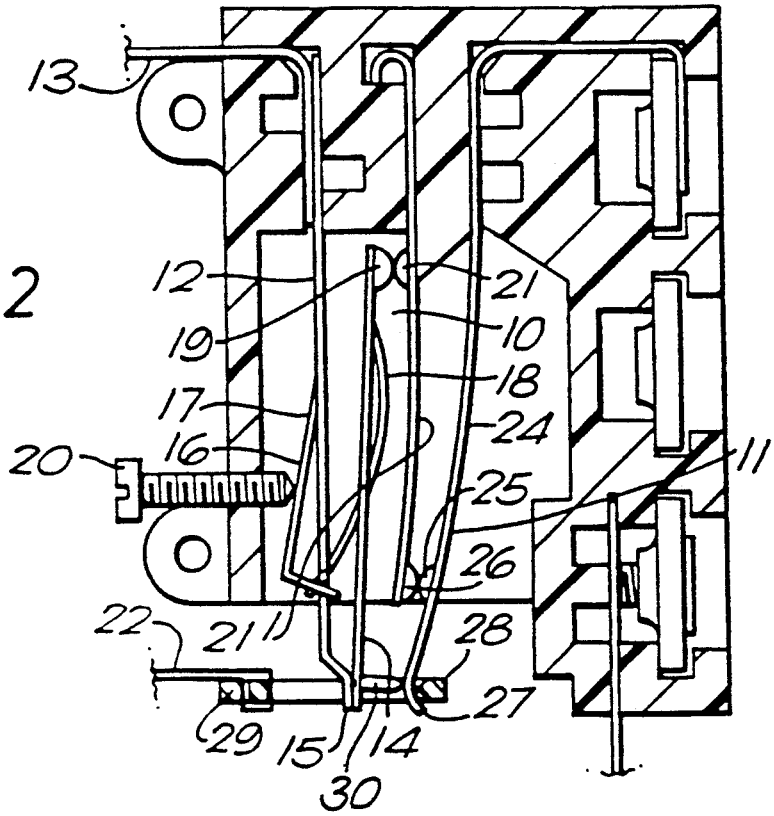
FIG. 2 shows the switch construction of FIG. 1 in more detail.

With reference to FIGS. 1 and 2 an iron comprises an aluminium or aluminium alloy sole plate 1 which has an element 2, shown schematically, and a switch unit 3. A flexible Invar tape 4, which acts as a low expansion reference member is fixed at one end with respect to the front portion of the sole plate in a mounting 5 which comprises a plug of fusible material, for a purpose which will be described later.

The tape 4 extends over a major portion of the length of the sole plate 1, and at its other end it is connected, in a manner to be described later, to the switch unit 3, which is fixedly mounted at the rear of the sole plate 1.

The switch unit 3 which is shown in more detail in FIG. 2, comprises a housing 6 which mounts live, neutral and earth terminals 7,8,9 and two switches 10,11. The neutral contact 8 is connected to the element 2 via a tab 8A, while the live contact is connected to the element 2 through the switches 10,11.

The switch 10 is a standard snap-acting C-spring type microswitch which is used to control the sole plate temperature. Such microswitches are very well known in the art. It comprises a first, rectangular, leaf member 12 which is fixed at one end in the housing 6 in contact with a live tab 13 leading to the element, and a second, rectangular leaf member 14 provided with a generally rectangular cut out which is joined to the first leaf member 12 at one end 15 and which carries at its other end a contact 19. The leaf member is provided with a U shaped cut out which defines a tongue member 16 which is integral at its end 17 with the first leaf member 12. The tongue 16 mounts, at its other end, one end of a C spring 18 whose other end is attached to the second leaf 14 adjacent movable contact 19. A calibration screw 20 is provided for moving the tongue 16 to initially calibrate the switch.

The microswitch 10 is essentially an over-centre geometrical mechanism, and will snap from its indicated closed position wherein movable contact 19 is in contact with fixed contact 21 to an open position when the leaf member 14 moves to the other side of the point of contact of the tongue 16 and 'C' spring 18. This movement is caused by the Invar tape 4 acting on the end 15 of the leaf members 12,14. As the sole plate 1 expands with temperature, the tape 4 will remain at a relatively constant reference length by virtue of its low coefficient of thermal expansion. Since the switch housing 6 is fixed on the sole plate 1, as the sole plate expands, it moves relative to the end 22 of the tape 4 which is connected to the microswitch leaf members 12,14 by a connecting member 29. The end 15 of the leaf members 12,14 is thus pulled to the left (in the sense of FIGS. 1 and 2) relative to the mounting as the sole plate 1 expands, and when the above geometric condition prevails, the movable contact 19 will snap away from the fixed contact 21 which is provided on a leaf spring 21". As the sole plate cools, the reverse relative movement will occur and the contacts 19,21 will, in due course, snap shut again.

The temperature at which the microswitch 10 operates is set by means 23 shown schematically in FIG. 1. In its simplest form the setting means 23 comprises a split collar connected to an external temperature setting dial and which fits over the tape 4. The collar is twisted as shown by arrow 'A' to locally distort the tape 4 into a shallow 'S' shape. This will shorten the effective length of the tape 4 and move the end 15 of the microswitch leaves 12,14 so that a smaller temperature rise will be needed to operate the switch.

Turning to the switch 11, this is a thermal protection switch which is intended to operate if for some reason the thermostat switch 10 fails and the sole plate 1 overheats, and is connected in series with the switch 10. It comprises a movable contact 25 mounted on a leaf spring 24 and a contact 26 which is mounted at the lower end of the leaf spring 21'. The contacts 25,26 are closed during normal operation of the iron. The free end 27 of leaf spring 24 engages an abutment 28 which is provided within the connecting member 29 attached to the end 22 of the tape 4 so that when assembled the leaf spring 24 places the tape 24 in tension. A push rod 30 of an electrically insulating material, for example a ceramic, extends between the free end 27 of leaf spring 24 and the end 15 of the microswitch so as to transmit the movement of the connecting member 29 thereto.

As was said above, the front end of the tape 4 is held by a fusible plug 5, so that should the sole plate overheat, the plug 5 will melt, the front end of the tape 4 will be released and the spring 24 will recoil to open the contacts 25,26 to cut the power to the heating element 2.

Figure 3A:
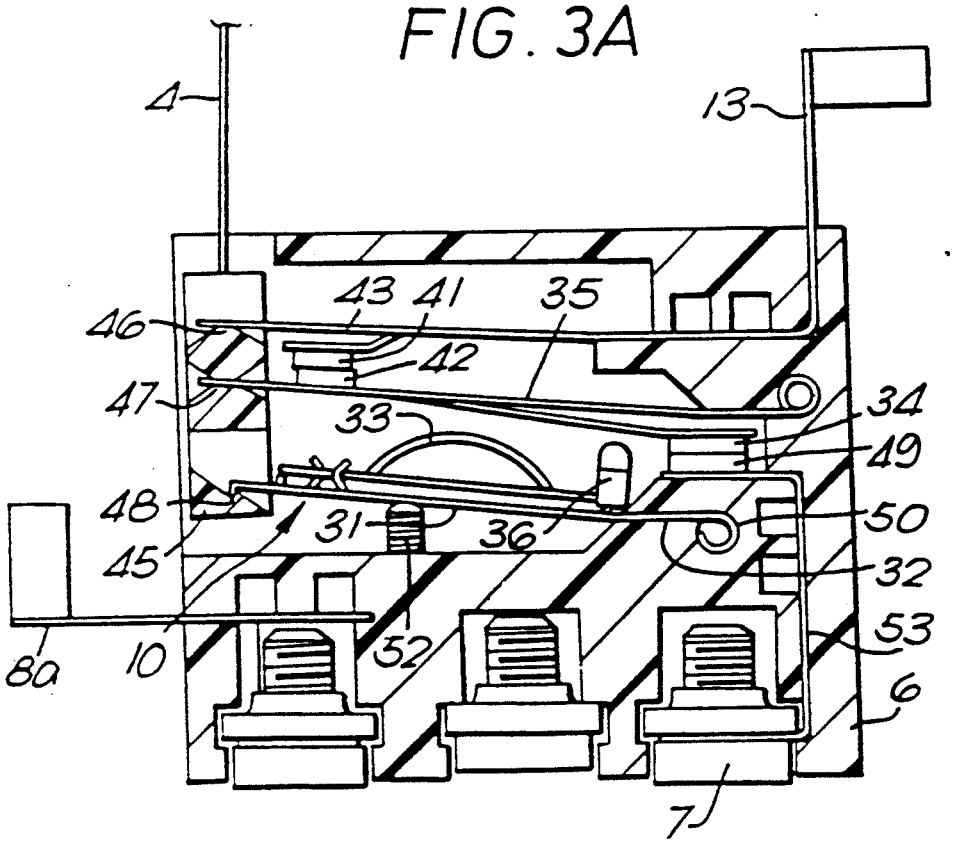
FIGS. 3A, 3B and 3C shows an alternative switch construction for use in the embodiment of FIG. 1 in three stages of operation.
Figure 3B:
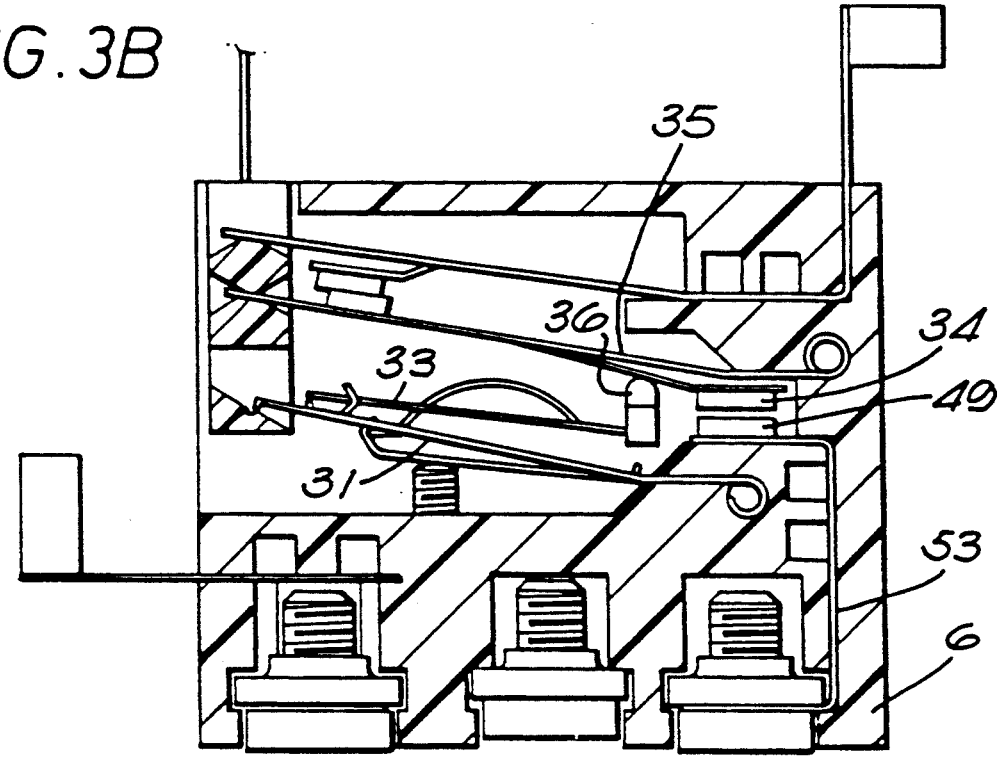
Figure 3C:
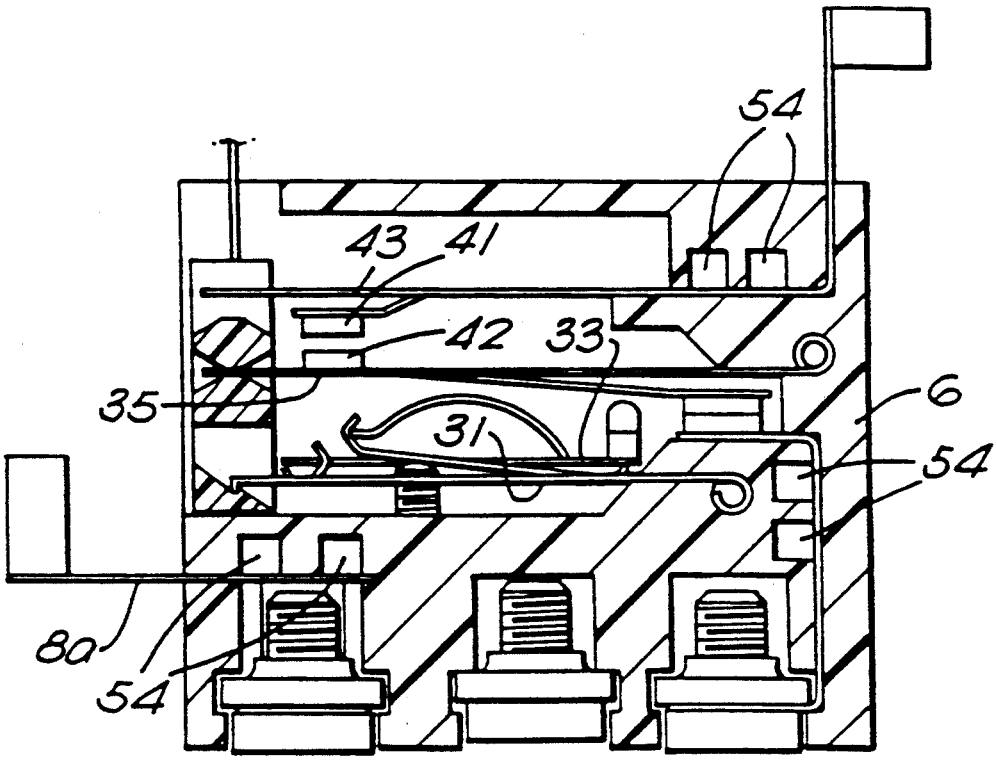

With reference now to FIG. 3A to 3C, there is shown an alternative switch construction in accordance with the invention. Components having the same functions as those referred to in FIGS. 1 and 2 are given the same reference numerals in these Figures. FIG. 3A shows the switch in the condition where the iron sole plate is heating and the thermostatic microswitch 10 is just on the point of tripping. FIG. 3B shows the condition where the microswitch 10 has tripped to cut the power to the heating element. FIG. 3C shows the condition in which the sole plate has over heated and the thermal fuse 5 has melted to allow the thermal protection switch 11 to open.

With reference to FIG. 3A, in this embodiment, the thermostatic microswitch 10 comprises first and second pivotally interconnected leaf members 31,33. First leaf 31 is fixed in a moulded plastics housing 6 at its end 32 by a spring tag 50 engaging in a corresponding bore in the housing 6. The second leaf 33 in this embodiment, does not, however, carry a switch contact, but instead moves a remote contact 34, which is mounted on a leaf spring 35, by virtue of a push rod 36 which is mounted on the free end of the second leaf 33. The first and second leaves 31,33 are in this embodiment, pivotally connected with knife edges formed on an inwardly facing surface of the second leaf member 33 engaging in V grooves formed in leaf member 31.

Figure 4A:
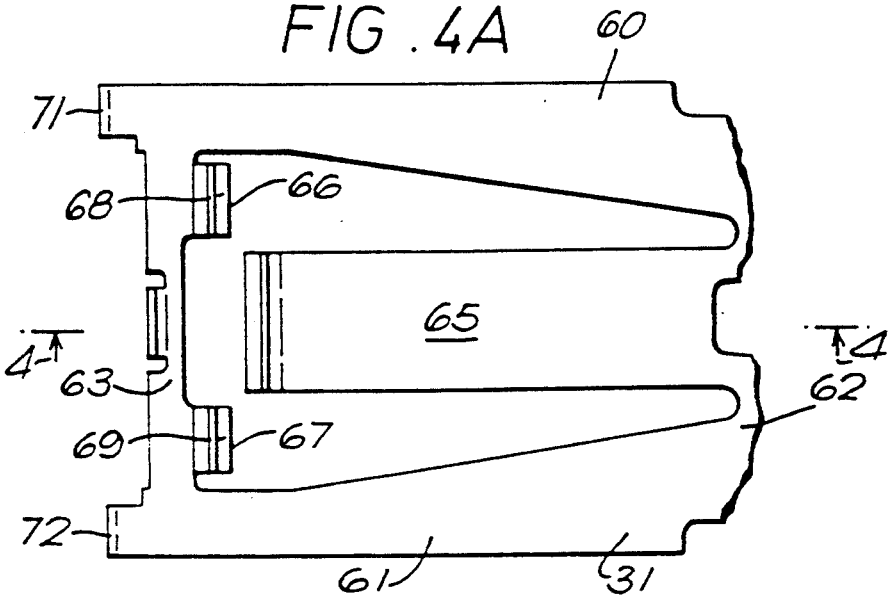
FIG. 4A and 4B show views of one component of the switch shown in FIGS. 3A to 3C, FIG. 4B being a sectional view along the line 4—4 of FIG. 4A.
Figure 4B:
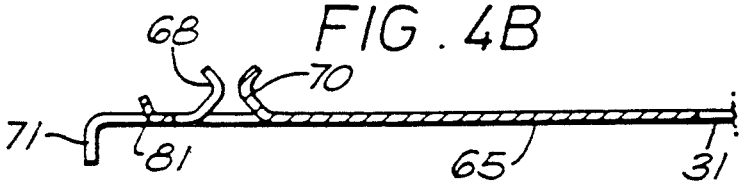

As can be seen from FIGS. 4A and 4B, the first leaf member 31 is generally rectangular in shape having two outer limbs 60,61 a connecting web 62 and a cross web 63. A central limb 65 extends from the connecting web 62 and together with the outer limbs 60,61 forms a generally W shaped configuration. The connecting web 62 extends into the spring tag 50 (not shown).

Tabs 66,67 forming V grooves 68,69 are bent up from the inner edge of the cross web 63 adjacent the ends of the outer limbs 60,61. The portion of the cross web 63 between the tabs 66,67 could be conveniently omitted. The end of the central limb 65 is also bent into a V groove 70. Tabs 71,72 are formed at the ends of the outer limbs 60,61 for engagement with external actuating means. A tab (not shown in FIG. 3) may also be bent up at the root of the central limb 65 to act as a back stop.

Figure 5A:
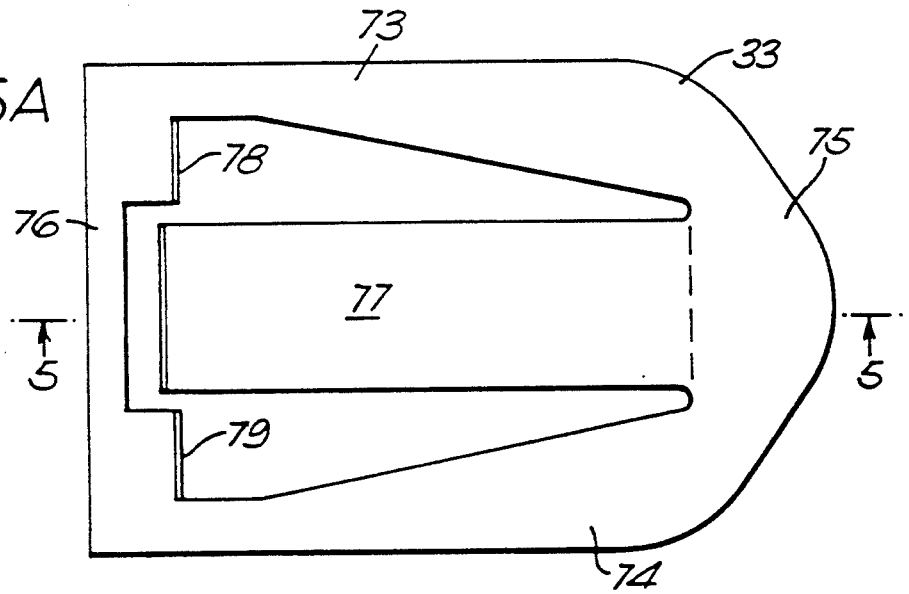
FIGS. 5A and 5B show views of another component of the switch of FIGS. 3A to 3C.
Figure 5B:
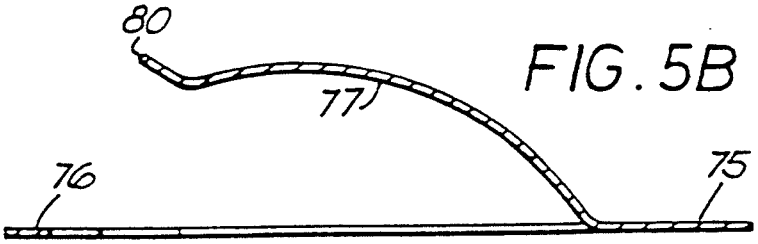

With reference to FIGS. 5A and 5B, the second leaf member 33 is also generally rectangular in shape having outer limbs 73,74 connected at one end by a connecting web 75 and at the other end by a cross web 76. A 'C' spring member 77 is formed from a tongue formed integrally with the leaf member 33 and extending connecting web 75 and is bent to the form shown in FIG. 5B.

Knife edges are formed on the inward facing edges 78,79 of the cross web 76 for pivotal engagement in the grooves 68,69 formed on the first leaf member 31, and also on the end 80 of the 'C' spring member 77 for engagement in groove 70 on the central limb 65 of the first leaf member 31.

The micro switch 10 is assembled by the knife edges 78,79 first being located in V grooves 68,69 and the 'C' spring 77 then being flexed from its configuration shown in FIG. 5A so as to engage the knife edge 80 in groove 70. A tab 81 may be provided on first leaf member 31 to facilitate correct positioning of the knife edges in the grooves 68,69 during assembly.

The thermal protection switch 11 has contacts 41,42 which are provided at the free ends of respective leaf spring members 43,35. It will thus be seen that contact 42 of the thermal protection switch Il is in direct electrical contact with the moving contact 34 of the microswitch 10 through the leaf spring member 35 which may conveniently be a rectangular leaf provided with a U shaped aperture to define a centrally projecting tongue which mounts the contact 34. One end of the leaf spring member 35 is fixed in the housing 6 as shown.

The tape 4 is connected to the switches 10,11 by an insulating member 45. The leaf spring members 35,43 and the microswitch leaf member 31 maintain the tape 4 in tension. The free end of each of these members is formed as a pair of fingers which engage either side of the insulating member 45. Spring member 43 engages abutments 46 on either side of the insulating body 45, leaf 44 engages in slots 47 and the microswitch leaf member 31 engages abutments 48.

With reference to FIG. 3A, when the iron is heating, power will be supplied to the element from live terminal 7 through link 53, contacts 49,34, spring member 35, contacts 42,41, spring member 43 and tab 13. As the sole plate heats, relative movement of the tape and housing 6 (which is fixed to the sole plate 1), moves the free end of the microswitch leaf member 31 to the point where the 'C' spring 38 goes over centre and snaps the leaf member 33 away from leaf member 31. The push rod 36 mounted on the free end 75 of the second leaf member thus moves towards and engages the leaf member 35 so as to push the contacts 34,49 apart and cut power to the element. This condition is shown in FIG. 3B. It will be noted that since the free end of the push rod 36 is not in contact with the leaf spring member 35 while the contacts 34,49 are closed, it will strike the leaf 35 with an impetus, so helping to break any microwelds which may have formed between the contacts 34,49. As the sole plate cools, the leaf member 31 moves back and the 'C' spring will again go over centre, in the opposite sense to allow the contacts 34,39 to remake under the action of the leaf spring member 35. As stated earlier by varying the effective length of the tape 4, the amount of movement of the leaf member 31, and thus the temperature rise required to trip the switch can be varied. However the switch may be initially calibrated by moving a set screw 52 in and out which changes the geometry of the switch by movement of the centre limb 65.

Should the thermostat microswitch 10 fail for some reason and the temperature of the sole plate 1 will continue to rise it will eventually reach a critical temperature, at which the fusible plug 5 will melt and the leaf springs 43,35 move to the position shown in FIG. 3C, opening the contacts 41,42 to cut the power to the element.

Pairs of apertures 54 are provided in the housing 6 to accept neon indicators as required, for example to indicate mains power, element on/off and thermostat on/-off.

Figure 6:
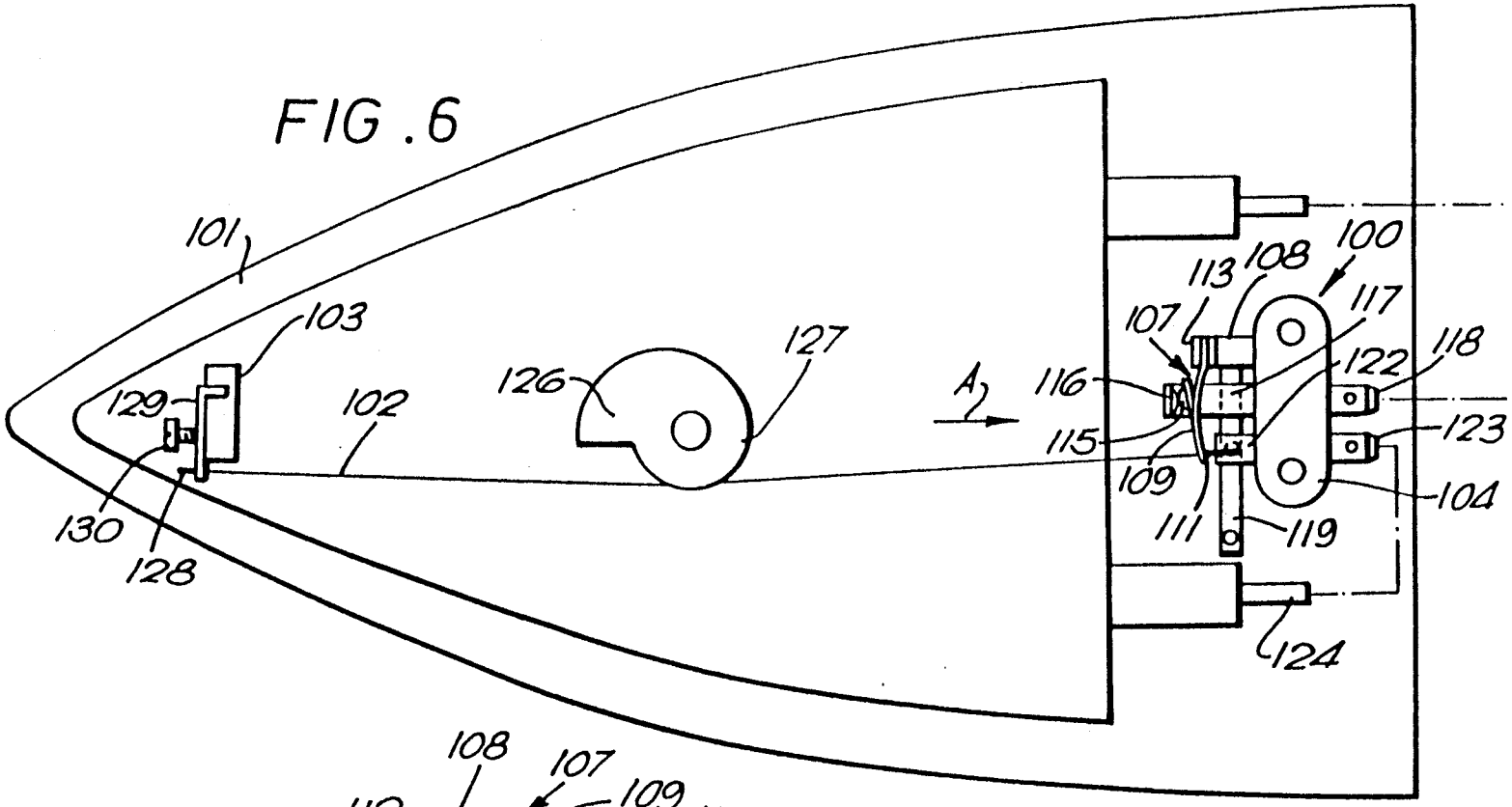
FIG. 6 shows a schematic plan view of a further embodiment of the invention.
Figure 7:
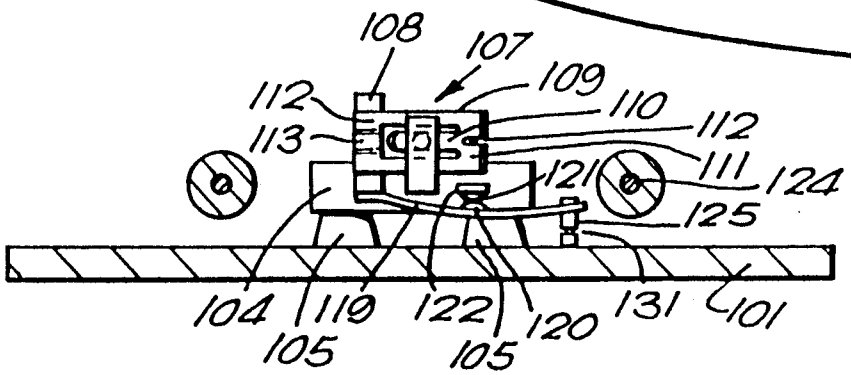
FIG. 7 shows a view taken in the direction of arrow A in FIG. 6.

A second embodiment of the invention will now be described with reference to FIGS. 6 and 7. As in the earlier embodiments, a switch unit 100 is arranged at the rear of a sole plate 101. A flexible reference member 102 in the form of a glass string extends over a major portion of the length of the sole plate 101 from a mounting 103 at the front of the sole plate 101 to the switch unit 100.

The switch unit 100 is an integrated thermostatic and thermal protection switch unit and comprises a mounting block 104 of a temperature resistant plastics material such as Ryton or Kinel. The block 104 is mounted to the sole plate 101 on spacing pillars 105 which are preferably of a low thermal conductivity material such as stainless steel, so as to thermally insulate the block 104 from the sole plate 101.

A single blade actuator 107 is mounted, by spot welding for example, to a support tab 108 insert moulded in the block 104. The actuator 107 is of a type hereinbefore described. Such actuators are well known in the art and described in general terms in GB 657434. It is formed from a generally rectangular blade 109 of resilient sheet metal having a U shaped cut out which defines a tongue 110 remaining attached to one end 111 of the blade 109. The other end of the blade is crimped at 113 which acts to draw the sides of the blade together so as to stress the blade such that if the end 111 is moved relative to the crimped end the blade 109 will reverse its curvature with a snap action. This causes the tongue 110 to move from its rest position with a snap action. As the end returns to it starting position, the blade 109 will snap back to its original configuration and the tongue 110 likewise. The end 111 is provided with a slot 112 which receives one end of the glass string 102, and applies a tensile force on the string 102 when assembled.

The tongue 110 is provided with a contact 115 which cooperates, in the rest position of the tongue, with a contact 116 mounted on an upstanding portion of a tab member 117. The tab member 117 is insert moulded in the block 104 and is provided at its other end with a spade connector 118 for connection to a power supply (not shown).

The tab member 108 also mounts, by welding for example, a resilient leaf member 119 which has a contact 120 mounted at a position intermediate its length. The contact 120 cooperates, in normal operation of the iron, with a further contact 121 mounted on the underside of a further tab 122 insert moulded in the block 104 and provided with a spade connector 123 for connection to the element 124. The leaf member 119 also mounts, at its free end, a thermal fuse member 125. This member is a rod of a thermally deformable plastics material and is similar to, and operates on the same principle as a thermal fuse already widely used in commercial kettle controls and described in applicants UK Patent Application GB-A-2204450. The lower end of the rod 125 is pressed against the sole plate 101 by the leaf member 119, such that in the normal operation of the iron, the contacts 120,121 are held closed.

A control member 126 having a cam surface 127 engages the glass string 102 approximately half way along its length (although it may be positioned at any convenient position along the length). The control member 126 is connected to a knob (not shown) which may be manipulated by a user to set a desired operating temperature of the iron as will be described later. Furthermore, the mounting 103 allows for initial calibration of the switch unit 100. The end 128 of the glass string 102 is retained in a slotted leg 129 which mounts a calibration screw 130, and which is mounted in the block 103 so as to be movable towards or away from the block by loosening or tightening the screw 130.

Operation of this embodiment will now be described. In the condition illustrated, the iron has not reached the desired temperature and the contacts 115,116 are closed. Furthermore, the thermal fuse 125 has not operated, so that the contacts 120,121 are also closed. Power is thus transmitted to one pole of the element 124 from the connector 118 via the tab 117, the contacts 116,115, the actuator 107, the tab 108, the leaf member 119, the contacts 120,121 the tab 122 and the connector 123. As the temperature of the sole plate 101 rises and the sole plate 101 expands, the switch unit 100 will move to the right (in the sense of FIG. 6) relative to the mounting 103, so that the glass string 102 will pull the end 111 of the actuator to the left. At a certain displacement, corresponding to a temperature predetermined by the setting of the control member 126, the end 111 of the actuator will have moved to the point at which the blade 109 reverses its curvature with a snap action whereupon the tongue 110 moves to the right, with a snap action, to break the contacts 115,116 and so interrupt the power supply to the element 124. As the sole plate cools, the end 111 is allowed to move to the right, relatively, and at a certain point the blade will snap back to its rest configuration and the tongue 110 will snap to the left to remake the contacts 115,116 and reconnect the power supply to the element 124.

It will be apparent that by turning the control member 126, the glass string 102 will be deflected laterally to a greater or lesser degree, so varying its effective length. The initial position of the free end 111 of the blade 109 will therefore be varied so that a greater or lesser movement, which corresponds to a greater or lesser rise in temperature of the sole plate 101, is required to trip the switch.

In the event that the contacts 115,116 weld together, or the actuator 107 fails to operate, the temperature of the sole plate 101 will continue to rise. The temperature will eventually reach the point at which the end of the thermal fuse 125 softens and deforms under the effect of heat. As it does so, it releases the leaf member 119, so that the contacts 121,122 will open to break the power circuit to the element 124. The material of the thermal fuse is chosen so that it will not deform under normal operating conditions, but will do so before the sole plate temperature becomes dangerously high. A region 131 of reduced cross-section is provided adjacent the free end of the push rod to allow rapid operation of the fuse when the critical temperature is reached, while avoiding the problems of thermal creep due to the relatively large area of the rod 125 on contact with the sole plate 101.

Figure 8:
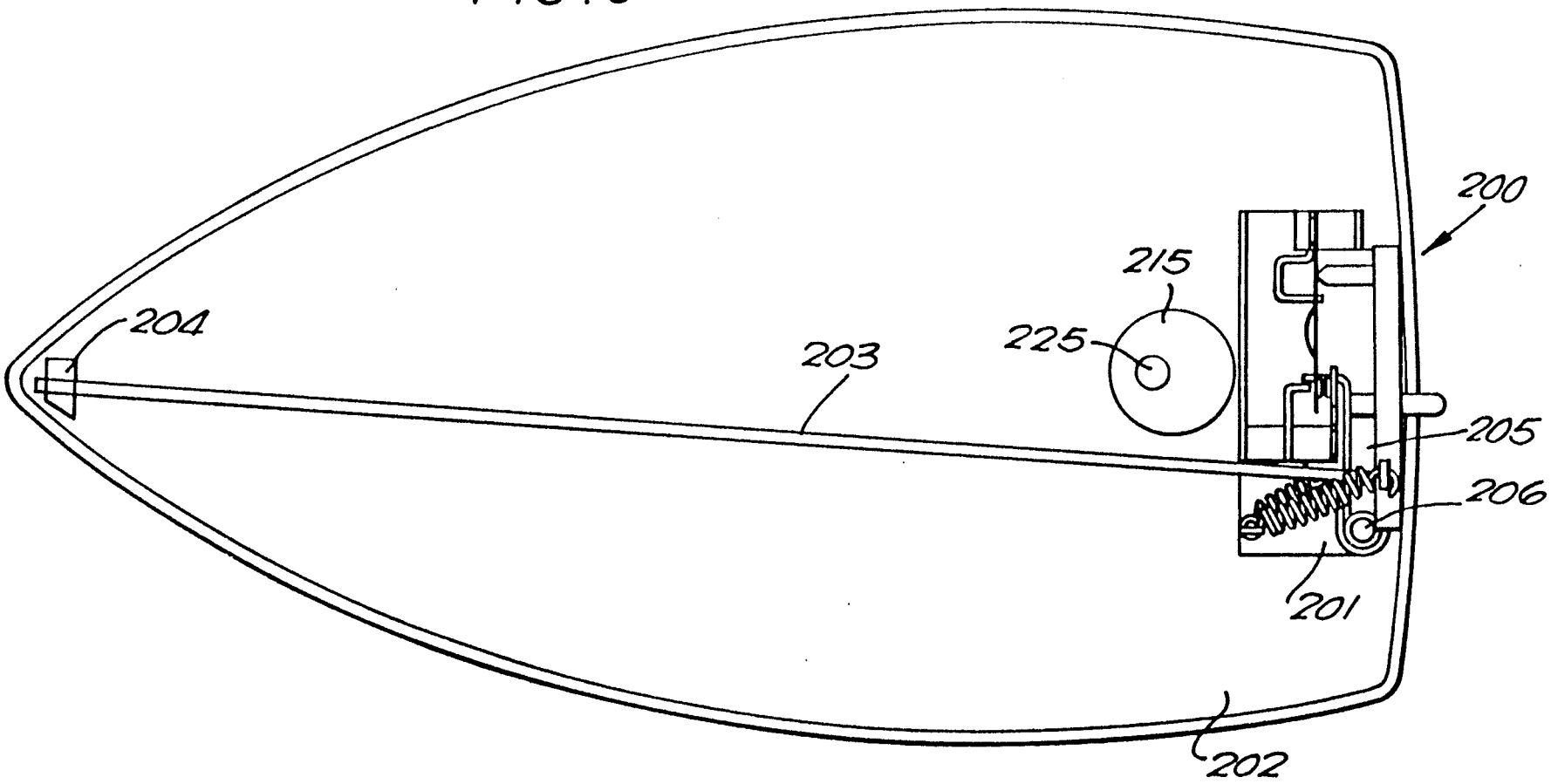
FIG. 8 shows schematically a further embodiment of the invention.
Figure 9:
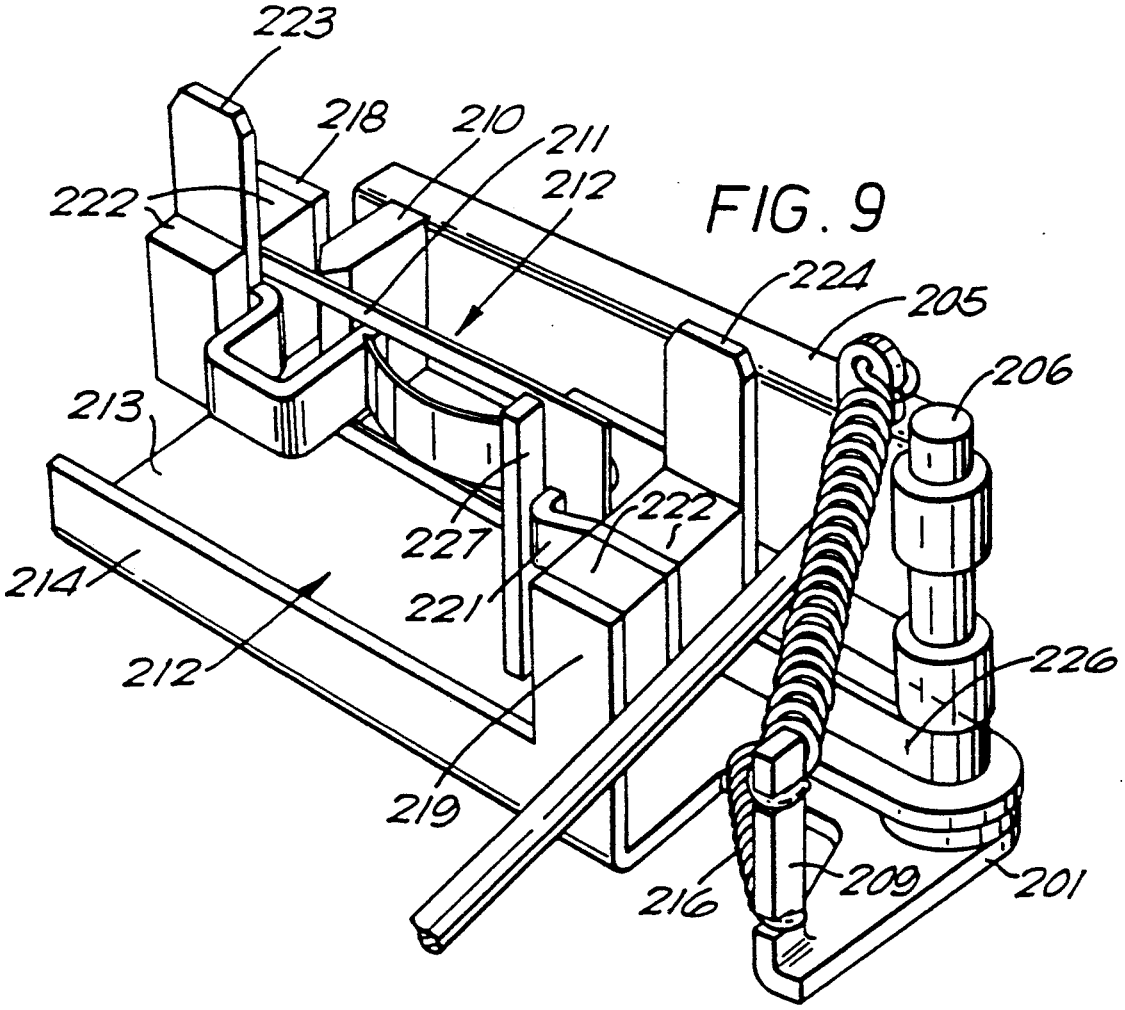
FIG. 9 shows a perspective view of the switch unit shown in FIG. 8.
Figure 10:
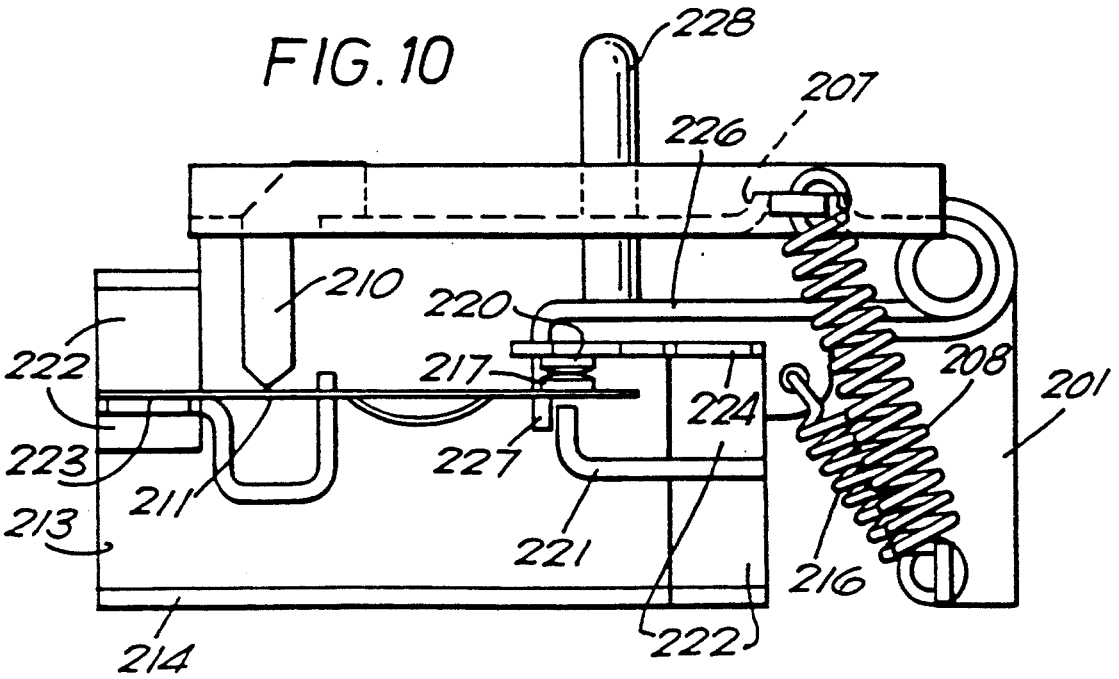
FIG. 10 shows a plan, and view of the switch unit of FIG. 9.

Turning now to FIGS. 8 to 10, there is shown a further embodiment of the invention. The control comprises a switch unit 200 mounted via a base plate 201 at the rear of the sole plate 202 and an Invar rod 203 extending between a mounting 204 at the nose of the sole plate and a lever 205 of the switch unit 200. The lever 205 is pivotally mounted on a pillar 206 extending upwardly from the base plate 201, and the end of the Invar rod 203 is held in compression in a dimple 207 on the lever 205 by means of a tension spring 208 extending between the lever 205 and an upward extension 209 of the base plate 201.

At the end of the lever 205 removed from the pillar 206 is an actuating member 210 which bears on the spring 211 of a snap acting microswitch assembly 212. The microswitch assembly 212 comprises a mounting plate 213 which is pivotally mounted on pillar 206. The plate 213 has an upwardly facing lip 214 at the front for engagement with a temperature setting member 215, against which it is held by a tension spring 216 which extends between the plate 213 and the extension 209. The movable contact 217 of the switch is provided on the free end of the spring 211 which is itself mounted electrical via insulation blocks 222 on a pillar 218 upstanding from the mounting plate 213. A further pillar 219 supports the fixed contact 220, and also a backstop 221 for the movable contact 217. Again insulation blocks 222 are provided. Spade connectors 223,224 are in electrical contact with the movable and fixed contacts 217,220 respectively, one being connected to the power supply and the other to a pole of the element.

In operation as the temperature of the sole plate 202 increases, relative movement of the rod 203 and sole plate causes the lever 205 to turn anticlockwise about the pillar 206 under the action of the spring 208. The lever 205 magnifies the relative movement of the sole plate 202 and the rod 203, with the result that the movement of the actuating member 210 will be greater than this movement by a factor equal to the ratio of the distance of the actuating member from the pivot point to the distance of the rod location point from the pivot point. When the actuating member 210 has moved sufficiently, it will cause the spring 211 to snap open the contacts 217,220 and so break the supply to the element.

The temperature at which the iron will switch off is set using the setting member 215. This is essentially an eccentrically mounted cam which is connected to an external dial or other control member by a rod 225. As the member 215 is rotated, it pivots the switch mounting plate 213 around the pillar 206, and thus changes its position with respect to the actuating member 210 which is independently mounted on the pillar 216. By pivoting the mounting plate 213 clockwise around the pillar 72, the setting temperature will be reduced since the actuating member 210 will not need to travel as far or apply as great a force to trip the switch, and a lower sole plate temperature will thus be required to produce the reduced relative expansion necessary to produce the required movement of the actuating member 210. Similarly a greater sole plate temperature would be required to trip the switch if the control mounting plate 213 were to be pivoted anticlockwise around the pillar 206.

A further feature of the control unit will now be described. A reset member 226 is pivotally mounted on pillar 206 and comprises a post 227 which projects up behind the movable contact 217 and a rod 218 which extends rearwardly from the control to abut a surface on the iron stand. When the iron is off the stand the post 227 is urged against the movable contact 217 by spring means (not shown) so as to close the contacts. The spring force is chosen so as to overcome the force applied to the microswitch spring 211 by the actuating member 210 so that even when the latter has caused the contacts to open when the iron is on the stand, the contacts will close again as soon as the iron is lifted from the stand. Thus when the iron is replaced on the stand, the contacts will be in the closed position and the element will commence heating immediately. As the iron is replaced on the stand, rod 228 engages the stand and pushes the post 227 away from the contacts 219,220 to allow the latter to snap open when the correct temperature is reached. The contacts may even snap open immediately if the iron has not cooled significantly during use since actuating member 210 will still be applying force to the microswitch spring 211.

It will thus be clear to a person skilled in the art that the present invention provides at least in it preferred embodiments an iron thermostatic control which utilises the temperature of the sole plate directly, which allows for more accurate and responsive control. It also provides for a compact control construction with a single unit housing a thermostatic switch unit and a thermal protection switch unit.

We claim:

1. An iron comprising: a sole plate which expands and contracts under heating and cooling; a flexible low expansion reference member extending over a major portion of the length of the sole plate, the reference member being held in tension and having two ends, one end of said reference member being attached to the sole plate at a first point, and the other end of said reference member being attached at a second point which is spaced from the first point to switch means activated by relative movement of said sole plate and said reference member occurring as a result of the expansion and contraction of the sole plate relative to the reference member; and means for deflecting the reference member at a position intermediate the ends of said reference member so as to vary the spacing between the said first and second points of attachment of the ends of the reference member to the sole plate and switch means respectively and thereby vary the temperature at which the switch means will operate.

2. An iron as claimed in claim 1, wherein said means for deflecting the reference member comprises a cam member engaging the reference member and deflecting said reference member laterally with respect to the sole plate.

3. An iron comprising: a sole plate which expands and contracts under heating and cooling; a flexible low expansion reference member extending over a major portion of the length of the sole plate, the reference member being held in tension and having two ends, one end of said reference member being attached to the sole plate at a first point, and the other end of said reference member being attached at a second point which is spaced from the first point to switch means activated by relative movement of said sole plate and said reference member occurring as a result of the expansion and contraction of the sole plate relative to the reference member; and means for locally twisting the reference member about an axis generally perpendicular to the length of the reference member so as to vary the spacing between the said first and second points of attachment of the ends of the reference member to the sole plate and switch means respectively and thereby vary the temperature at which the switch means will operate.

4. An iron as claimed in claim 1 or 3, wherein said sole plate has a front end and a rear end and wherein said reference member is held fixedly at the front end of said sole plate and extends rearwardly to said switch means which is mounted at the rear of said sole plate.

5. An iron as claimed in claim 1 or 3, wherein said switch means is snap-acting.

6. An iron as claimed in claim 5, wherein said switch means is a microswitch.

7. An iron as claimed in claim 6, wherein said microswitch is a C-spring type microswitch.

8. An iron as claimed in claim 5, wherein said switch means is a C-spring type actuator.

9. An iron as claimed in claim 1 or 3, wherein said flexible reference member comprises tape.

10. An iron as claimed in claim 1 or 3, wherein said reference member is a string.

11. An iron comprising: a sole plate which expands and contracts under heating and cooling; a flexible low expansion reference member extending over a major portion of the length of the sole plate, the reference member being held in tension and having two ends, one end of said reference member being attached to the sole plate at a first point, and the other end of said reference member being attached at a second point which is spaced from the first point to switch means activated by relative movement of said sole plate and said reference member occurring as a result of the expansion and contraction of the sole plate relative to the reference member; means for varying the spacing between the said first and second points of attachment of the ends of the reference member to the sole plate and switch means respectively and thereby varying the temperature at which the switch means will operate; and wherein said reference member is fixedly retained at one of its ends by a fusible member which melts in the event of the sole plate overheating to release the reference member, said reference member cooperating with a set of contacts so as to open said contacts when so released, thereby interrupting the power supply to a heating element of the iron.

12. An iron comprising: a sole plate which expands and contracts under heating and cooling; a flexible low expansion reference member extending over a major portion of the length of the sole plate, the reference member being held in tension and having two ends, one end of said reference member being attached to the sole plate at a first point, and the other end of said reference member being attached at a second point which is spaced from the first point to switch means activated by relative movement of said sole plate and said reference member occurring as a result of the expansion and contraction of the sole plate relative to the reference member; means for varying the spacing between the said first and second points of attachment of the ends of the reference member to the sole plate and switch means respectively and thereby varying the temperature at which the switch means will operate; and thermal protection means for interrupting the power supply to a heating element of the iron in the event that the sole plate overheats, said thermal protection means including a thermally deformable member resiliently biased into thermal contact with a portion of the sole plate by a spring mechanism, said deformable member being arranged to deform at a critical predetermined temperature so as to release said spring mechanism and open a set of contacts.

13. An iron as claimed in claim 12, wherein the said thermal protection means and said switch means are provided in an integral unit.

14. An iron as claimed in claim 13, wherein said integral unit is arranged at a rear end of the sole plate.

* * * * *